US011299867B2

(12) United States Patent
Kurokawa et al.

(10) Patent No.: US 11,299,867 B2
(45) Date of Patent: Apr. 12, 2022

(54) SHOVEL

(71) Applicant: SUMITOMO CONSTRUCTION MACHINERY CO., LTD., Tokyo (JP)

(72) Inventors: Tomoki Kurokawa, Chiba (JP); Hiroyuki Tsukamoto, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 148 days.

(21) Appl. No.: 16/779,808

(22) Filed: Feb. 3, 2020

(65) Prior Publication Data

US 2020/0173143 A1 Jun. 4, 2020

Related U.S. Application Data

(63) Continuation of application No. PCT/JP2018/031039, filed on Aug. 22, 2018.

(30) Foreign Application Priority Data

Aug. 23, 2017 (JP) ..... JP2017-160251

(51) Int. Cl.
*E02F 9/20* (2006.01)

(52) U.S. Cl.
CPC ..... *E02F 9/2025* (2013.01); *E02F 9/2004* (2013.01)

(58) Field of Classification Search
CPC . E02F 3/435; E02F 9/16; E02F 9/2004; E02F 9/2025; E02F 9/2285; E02F 9/24; E02F 9/26

See application file for complete search history.

(56) References Cited

U.S. PATENT DOCUMENTS 5,835,874 A * 11/1998 Hirata ..... E02F 3/435 701/50
6,032,093 A * 2/2000 Denbraber ..... E02F 3/308 37/348
6,095,944 A * 8/2000 Buchanan ..... B60T 11/103 192/220.1
7,975,410 B2 * 7/2011 Faivre ..... G05D 1/0891 37/348
8,195,367 B2 * 6/2012 Kim ..... B62D 33/063 701/50
9,404,237 B2 * 8/2016 Faivre ..... E02F 3/432
(Continued)

FOREIGN PATENT DOCUMENTS

JP 2003-184128 7/2003
JP 2003-221843 8/2003
(Continued)

OTHER PUBLICATIONS

International Search Report for PCT/JP2018/031039 dated Sep. 25, 2018.

*Primary Examiner* — Tyler J Lee
(74) *Attorney, Agent, or Firm* — IPUSA, PLLC

(57) ABSTRACT

A shovel includes a lower traveling body, an upper turning body turnably mounted on the lower traveling body, a cab mounted on the upper turning body, an operating apparatus installed in the cab, an actuator driven with the operating apparatus, and a processor configured to restrict the movement of the actuator. The processor is configured to determine the necessity of a restriction related to the movement of the actuator in accordance with whether the operating apparatus is operated with an operator's hand.

13 Claims, 9 Drawing Sheets

(56) References Cited

U.S. PATENT DOCUMENTS

| | | | | |
|---|---|---|---|---|
| 2004/0011154 | A1 | 1/2004 | Dybro | |
| 2009/0198382 | A1* | 8/2009 | Koch | E02F 3/432 700/275 |
| 2009/0293322 | A1* | 12/2009 | Faivre | G05D 1/0891 37/348 |
| 2015/0361640 | A1* | 12/2015 | Faivre | E02F 9/2012 701/50 |
| 2018/0002895 | A1 | 1/2018 | Misaki | |

FOREIGN PATENT DOCUMENTS

| | | |
|---|---|---|
| JP | 4237538 | 3/2009 |
| JP | 2010-250459 | 11/2010 |
| JP | 2012-021362 | 2/2012 |
| JP | 2013-076381 | 4/2013 |
| JP | 2013-249849 | 12/2013 |
| WO | 2016/152700 | 9/2016 |

* cited by examiner

SHOVEL

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2018/031039, filed on Aug. 22, 2018 and designating the U.S., which claims priority to Japanese patent application No. 2017-160251, filed on Aug. 23, 2017. The entire contents of the foregoing applications are incorporated herein by reference.

BACKGROUND

Technical Field

The present invention relates to shovels.

Description of Related Art

A shovel that can control accidental operation of a work machine (attachment) has been known. This shovel makes it impossible to operate the attachment with an operating lever when the operator is not wearing a seat belt. Furthermore, even when the operator is wearing a seat belt, the shovel makes it impossible to operate the attachment with an operating lever in response to determining that the sitting posture of the operator is so improper as to prevent the operator from seeing the attachment.

SUMMARY

According to an aspect of the present invention, a shovel includes a lower traveling body, an upper turning body turnably mounted on the lower traveling body, a cab mounted on the upper turning body, an operating apparatus installed in the cab, an actuator driven with the operating apparatus, and a processor configured to restrict the movement of the actuator. The processor is configured to determine the necessity of a restriction related to the movement of the actuator in accordance with whether the operating apparatus is operated with an operator's hand.

DETAILED DESCRIPTION

According to the above-described shovel, however, when the operator is wearing a seat belt in a proper sitting posture, that is, when it is allowed to operate the attachment with an operating lever, it is not possible to prevent the attachment from being accidentally operated in response to the operator's elbow contacting the operating lever, for example.

In view of the above, it is desired to provide a shovel that can more reliably prevent an operator from accidentally moving an actuator.

According to an aspect of the present invention, a shovel that can more reliably prevent an operator from accidentally moving an actuator is provided.

Figure 1:
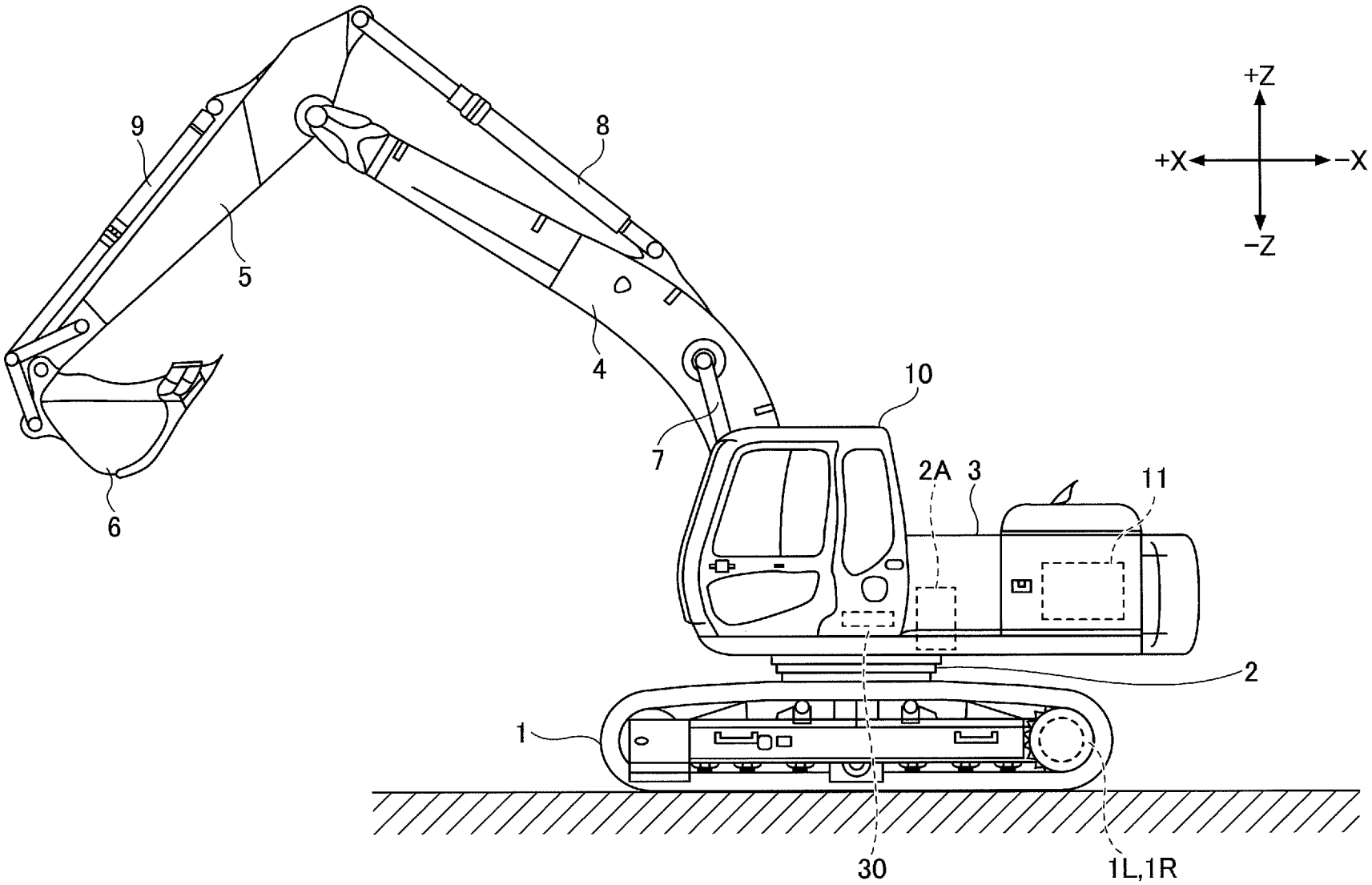
FIG. 1 is a side view of a shovel according to an embodiment of the present invention.

First, a shovel (excavator) according to an embodiment of the present invention is described with reference to FIG. 1. FIG. 1 is a side view of the shovel. An upper turning body 3 is turnably mounted on a lower traveling body 1 of the shovel illustrated in FIG. 1 through a turning mechanism 2. A boom 4 serving as a work element is attached to the upper turning body 3. An arm 5 serving as a work element is attached to the end of the boom 4. A bucket 6 serving as a work element and an end attachment is attached to the end of the arm 5. The boom 4 is driven by a boom cylinder 7. The arm 5 is driven by an arm cylinder 8. The bucket 6 is driven by a bucket cylinder 9. The lower traveling body 1 is driven by a left traveling hydraulic motor 1L and a right traveling hydraulic motor 1R. The turning mechanism 2 is driven by a turning hydraulic motor 2A. The turning mechanism 2 may alternatively be driven by an electric motor. A cab 10 is provided and a power source such as an engine 11 is mounted on the upper turning body 3. Furthermore, a controller 30, etc., are mounted on the upper turning body 3.

Figure 2:
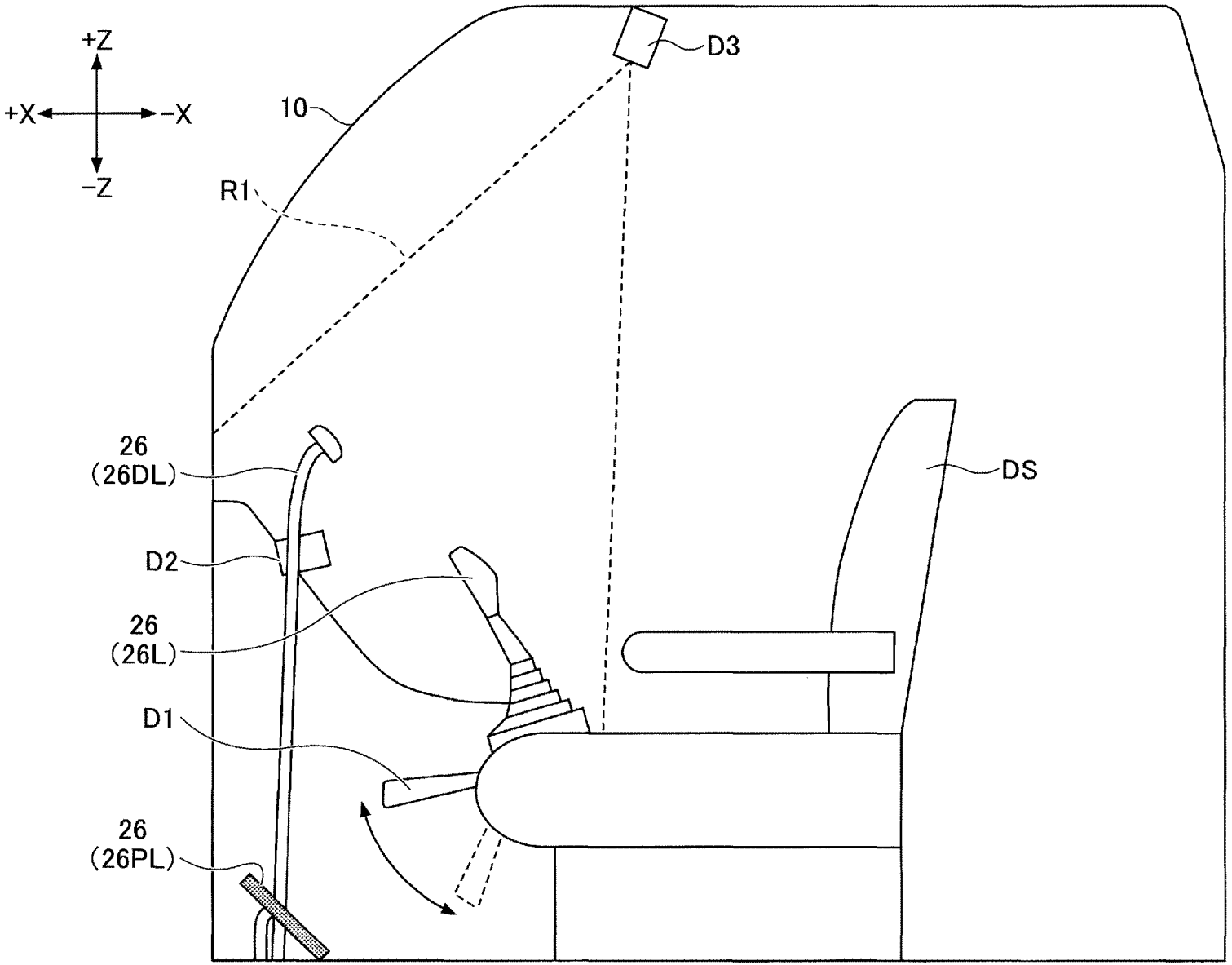
FIG. 2 is a side view of the inside of a cab of the shovel of FIG. 1.
Figure 3:
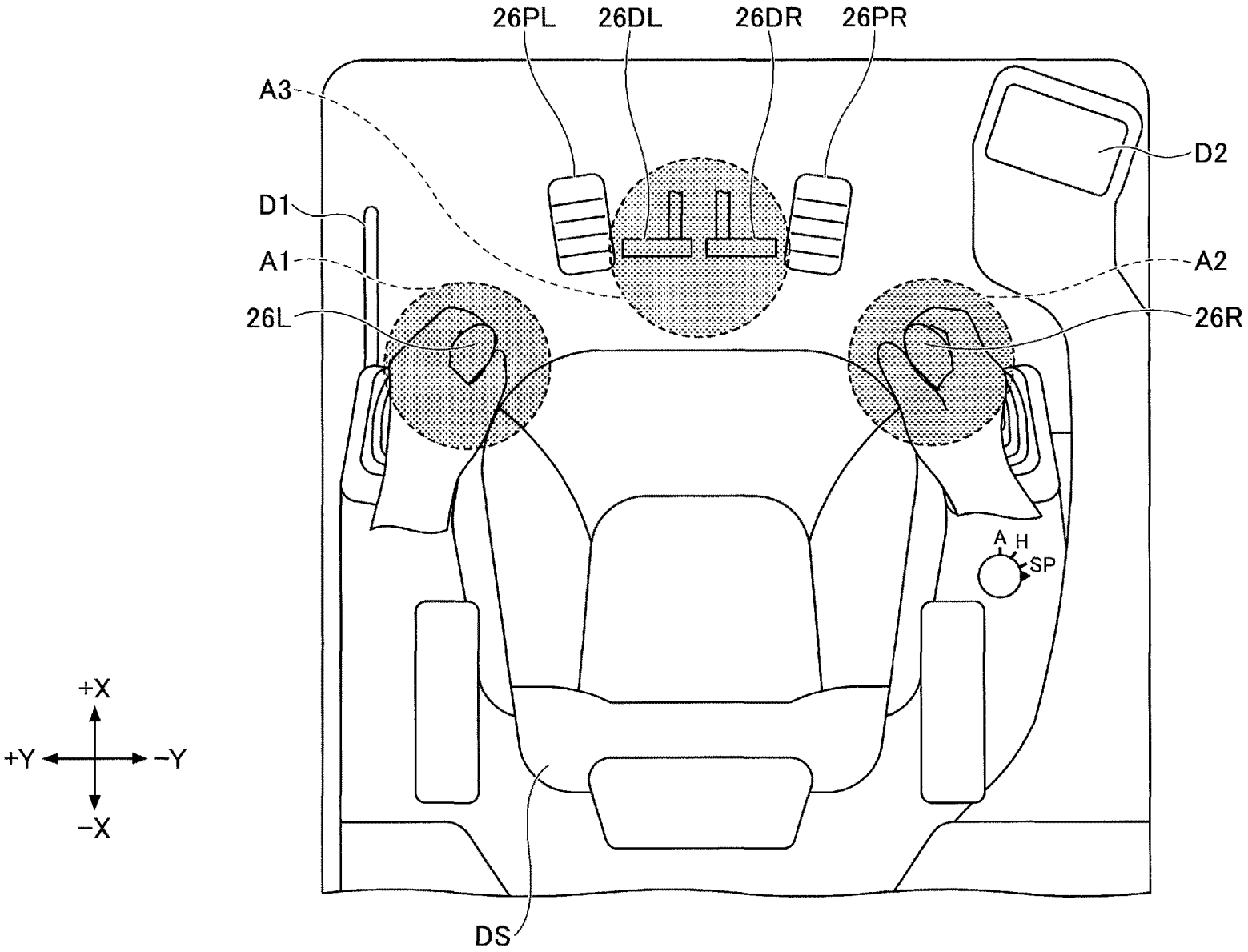
FIG. 3 is a plan view of the inside of the cab of FIG. 2.

Next, an internal configuration of the cab 10 is described with reference to FIGS. 2 and 3. FIG. 2 is a left side view of the inside of the cab 10. FIG. 3 is a plan view of the inside of the cab 10. In FIG. 3, for clarification purposes, only hands are depicted with respect to an operator.

An operator seat DS is installed in the center of the inside of the cab 10. An operating apparatus 26, a gate lock lever D1, a display device D2, etc., are installed in front of the operator seat DS. An image capturing device D3 is attached to the ceiling of the cab 10. A range R1 indicated by a dashed line in FIG. 2 represents the imaging range of the image capturing device D3.

The operating apparatus 26 is an apparatus that the operator uses to operate actuators. According to this embodiment, the actuators include hydraulic actuators such as the left traveling hydraulic motor 1L, the right traveling hydraulic motor 1R, the turning hydraulic motor 2A, the boom cylinder 7, the arm cylinder 8, and the bucket cylinder 9. The turning hydraulic motor 2A may alternatively be an electric motor. The operating apparatus 26 includes a left operating lever 26L, a right operating lever 26R, a left travel pedal 26PL, a right travel pedal 26PR, a left travel lever 26DL, and a right travel lever 26DR.

The left operating lever 26L is used to move, for example, the turning hydraulic motor 2A and the arm cylinder 8. The turning hydraulic motor 2A turns the upper turning body 3 clockwise in a plan view when the left operating lever 26L is tilted rightward (in the −Y direction). Conversely, the turning hydraulic motor 2A turns the upper turning body 3 counterclockwise in a plan view when the left operating lever 26L is tilted leftward (in the +Y direction). The arm cylinder 8 retracts to open the arm 5 when the left operating lever 26L is tilted forward (in the +X direction). Conversely, the arm cylinder 8 extends to close the arm 5 when the left operating lever 26L is tilted backward (in the −X direction).

The right operating lever 26R is used to move, for example, the boom cylinder 7 and the bucket cylinder 9. The boom cylinder 7 retracts to lower the boom 4 when the right operating lever 26R is tilted forward (in the +X direction). Conversely, the boom cylinder 7 extends to raise the boom 4 when the right operating lever 26R is tilted backward (in the −X direction). The bucket cylinder 9 extends to close the bucket 6 when the right operating lever 26R is tilted leftward (in the +Y direction). Conversely, the bucket cylinder 9 retracts to open the bucket 6 when the right operating lever 26R is tilted rightward (in the −Y direction).

The left travel lever 26DL and the left travel pedal 26PL are used to move the left traveling hydraulic motor 1L. According to this embodiment, the left travel pedal 26PL is directly connected to the left travel lever 26DL. The left traveling hydraulic motor 1L rotates forward when the left travel lever 26DL is tilted forward (in the +X direction) or the left travel pedal 26PL is pressed on its toe side. Conversely, the left traveling hydraulic motor 1L is reversed when the left travel lever 26DL is tilted backward (in the −X direction) or the left travel pedal 26PL is pressed on its heel side.

The right travel lever 26DR and the right travel pedal 26PR are used to move the right traveling hydraulic motor 1R. According to this embodiment, the right travel pedal 26PR is directly connected to the right travel lever 26DR. The right traveling hydraulic motor 1R rotates forward when the right travel lever 26DR is tilted forward (in the +X direction) or the right travel pedal 26PR is pressed on its toe side. Conversely, the right traveling hydraulic motor 1R is reversed when the right travel lever 26DR is tilted backward (in the −X direction) or the right travel pedal 26PR is pressed on its heel side.

The gate lock lever D1 switches the operating apparatus 26 between a restricted state and a disabled state. The disabled state of the operating apparatus 26 means a state where a corresponding actuator does not move in response to the operator's operation of the operating apparatus 26. The restricted state of the operating apparatus 26 means a state where a corresponding actuator moves in response to the operator's operation of the operating apparatus 26 if a predetermined restriction cancellation condition is satisfied and the movement of the corresponding actuator is restricted even when the operator operates the operating apparatus 26 if the predetermined restriction cancellation condition is not satisfied. That is, when the predetermined restriction cancellation condition is satisfied, the restricted state of the operating apparatus 26 corresponds to the enabled state of the operating apparatus 26. The enabled state of the operating apparatus 26 means a state where a corresponding actuator moves in response to the operator's operation of the operating apparatus 26. The predetermined restriction cancellation condition is satisfied when the operating apparatus 26 is operated with the operator's hand, for example. Examples of "the case where the operating apparatus 26 is operated with the operator's hand" include the case where the left operating lever 26L is tilted with the left hand while the left operating lever 26L is held with the left hand the right operating lever 26R is held with the right hand. For example, when the operating apparatus 26 is operated with the operator's hand, the predetermined restriction cancellation condition remains satisfied before the operation of the operating apparatus 26 is stopped. An actuator corresponding to the operating apparatus 26 in the restricted state is so controlled as not to move even when the operating apparatus 26 is operated or as not to move in the same manner as in the enabled state. Examples of "not moving in the same manner as in the enabled state" include a corresponding actuator moving slowly or moving only slightly compared with when the operating apparatus 26 is in the enabled state.

According to this embodiment, the gate lock lever D1 is installed at the left front end of the operator seat DS. The operator puts the operating apparatus 26 in the restricted state by pulling up the gate lock lever D1 to put the gate lock lever D1 in an unlocking state (the state indicated by a solid line in FIG. 2). Furthermore, the operator puts the operating apparatus 26 in the disabled state by pushing down the gate lock lever D1 to put the gate lock lever D1 in a locking state (the state indicated by a dashed line in FIG. 2).

The display device D2 displays various kinds of information. According to this embodiment, the display device D2 is a liquid crystal display and is installed on the front right of the operator seat DS. The display device D2 may be a portable terminal such as a smartphone.

The image capturing device D3 is an example of a detector that is used to detect that the operating apparatus 26 is operated with the operator's hand. According to this embodiment, the image capturing device D3 serving as a non-contact detector is a camera that captures an image of the operator seated in the operator seat DS, and is so attached to the ceiling of the cab 10 as to capture images of monitoring areas A1 through A3 illustrated in FIG. 3. The image capturing device D3 may be either composed of a single camera or composed of multiple cameras. That is, the image capturing device D3 may be so configured as to capture images of multiple monitoring areas simultaneously with a single camera or be so configured as to capture images of a single monitoring area with multiple cameras.

The camera may be either a monocular camera or a stereo camera. The non-contact detector may be a space recognition device such as a LIDAR or a millimeter wave radar, a combination of a camera and a space recognition device, or a combination of a monocular camera and a stereo camera.

The monitoring area A1 is an area monitored by the detector so that the controller 30 can determine, based on the output of the detector, whether the left operating lever 26L is operated with the operator's hand (left hand, for example), and corresponds to, for example, the range of movement of the left operating lever 26L.

The monitoring area A2 is an area monitored by the detector so that the controller 30 can determine, based on the output of the detector, whether the right operating lever 26R is operated with the operator's hand (right hand, for example), and corresponds to, for example, the range of movement of the right operating lever 26R.

The monitoring area A3 is an area monitored by the detector so that the controller 30 can determine, based on the output of the detector, whether the travel levers (the left travel lever 26DL and the right travel lever 26DR) are operated with the operator's hand or hands (right hand, left hand, or both hands, for example), and corresponds to, for example, the range of movement of the travel levers.

At least one of a seat occupation switch, a seat belt switch, etc., may be attached to the operator seat DS. The seat occupation switch outputs a signal representing the seat occupation status of the operator to the controller 30. For example, the seat occupation switch outputs a seating signal when the operator is seated in the operator seat DS. In this case, the seat occupation switch does not output a seating signal when the operator is not seated in the operator seat DS. The seat belt switch outputs a signal representing the wearing status of the seat belt to the controller 30. For example, the seat belt switch outputs a seat belt wearing signal when the operator seated in the operator seat DS is wearing a seat belt. In this case, the seat belt switch does not output a seat belt wearing signal when the operator is not wearing a seat belt.

Figure 4:
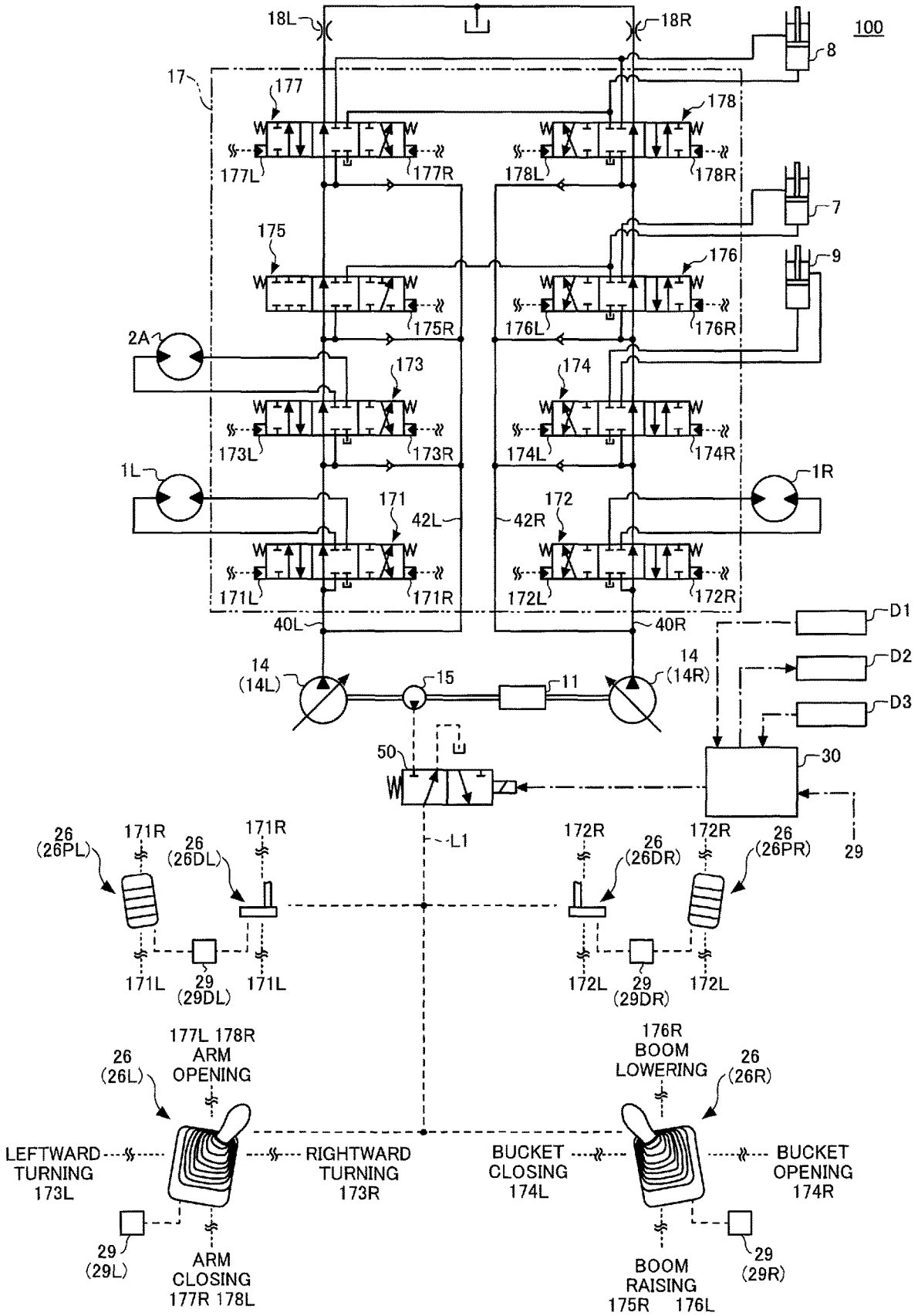
FIG. 4 is a diagram illustrating an example configuration of a control system installed in the shovel of FIG. 1.

Next, a control system 100 installed in the shovel of FIG. 1 is described with reference to FIG. 4. FIG. 4 is a schematic diagram illustrating an example configuration of the control system 100, where a mechanical power transmission line, a hydraulic oil line, a pilot line, and an electrical control line are indicated by a double line, a solid line, a dashed line, and a one-dot chain line, respectively.

The control system 100 mainly include the engine 11, a main pump 14, a pilot pump 15, a control valve 17, the operating apparatus 26, an operating pressure sensor 29, the controller 30, a gate lock valve 50, the gate lock lever D1, the display device D2, and the image capturing device D3.

The engine 11 is a drive source of the shovel. According to this embodiment, the engine 11 is, for example, a diesel engine that so operates as to maintain a predetermined rotational speed. The output shaft of the engine 11 is connected to the respective input shafts of the main pump 14 and the pilot pump 15.

The main pump 14 supplies hydraulic oil to the control valve 17 via a hydraulic oil line. According to this embodiment, the main pump 14 is a swash plate variable displacement hydraulic pump and includes main pumps 14L and 14R.

The pilot pump 15 is an example of a pilot pressure generator, and supplies hydraulic oil to various kinds of hydraulic control apparatus including the operating apparatus 26. According to this embodiment, the pilot pump 15 is a fixed displacement hydraulic pump. The pilot pressure generator, however, may be implemented by the main pump 14. That is, in addition to the function of supplying hydraulic oil to the control valve 17 via a hydraulic oil line, the main pump 14 may have the function of supplying hydraulic oil to various kinds of hydraulic control apparatus including the operating apparatus 26 via a pilot line.

The control valve 17 is a hydraulic controller that controls a hydraulic system in the shovel. According to this embodiment, the control valve 17 includes control valves 171 through 178 that control the flow of hydraulic oil discharged by the main pump 14. The control valve 17 selectively supplies hydraulic oil discharged by the main pump 14 to one or more hydraulic actuators through the control valves 171 through 178. The control valves 171 through 178 controls the flow rate of hydraulic oil flowing from the main pump 14 to hydraulic actuators and the flow rate of hydraulic oil flowing from hydraulic actuators to a hydraulic oil tank. The hydraulic actuators include the left traveling hydraulic motor 1L, the right traveling hydraulic motor 1R, the turning hydraulic motor 2A, the boom cylinder 7, the arm cylinder 8, and the bucket cylinder 9.

According to FIG. 4, the control system 100 circulates hydraulic oil from the main pumps 14L and 14R driven by the engine 11 to the hydraulic oil tank via center bypass conduits 40L and 40R, parallel conduits 42L and 42R, and throttles 18L and 18R.

The center bypass conduit 40L is a hydraulic oil line that passes through the control valves 171, 173, 175 and 177 placed in the control valve 17. The center bypass conduit 40R is a hydraulic oil line that passes through the control valves 172, 174, 176 and 178 placed in the control valve 17.

The control valve 171 is a spool valve that switches the flow of hydraulic oil in order to supply hydraulic oil discharged by the main pump 14L to the left traveling hydraulic motor 1L and to discharge hydraulic oil discharged by the left traveling hydraulic motor 1L to the hydraulic oil tank. When the left travel lever 26DL or the left travel pedal 26PL is tilted forward (in the +X direction), the control valve 171 receives a pilot pressure at a right pilot port 171R to move leftward to rotate the left traveling hydraulic motor 1L forward. Furthermore, when the left travel lever 26DL or the left travel pedal 26PL is tilted backward (in the −X direction), the control valve 171 receives a pilot pressure at a left pilot port 171L to move rightward to reverse the left traveling hydraulic motor M.

The control valve 172 is a spool valve that switches the flow of hydraulic oil in order to supply hydraulic oil discharged by the main pump 14L to the right traveling hydraulic motor 1R and to discharge hydraulic oil discharged by the right traveling hydraulic motor 1R to the hydraulic oil tank. When the right travel lever 26DR or the right travel pedal 26PR is tilted forward (in the +X direction), the control valve 172 receives a pilot pressure at a right pilot port 172R to move leftward to rotate the right traveling hydraulic motor 1R forward. Furthermore, when the right travel lever 26DR or the right travel pedal 26PR is tilted backward (in the −X direction), the control valve 172 receives a pilot pressure at a left pilot port 172L to move rightward to reverse the right traveling hydraulic motor 1R.

The control valve 173 is a spool valve that switches the flow of hydraulic oil in order to supply hydraulic oil discharged by the main pump 14L to the turning hydraulic motor 2A and to discharge hydraulic oil discharged by the turning hydraulic motor 2A to the hydraulic oil tank. When the left operating lever 26L is tilted rightward (in the −Y direction), the control valve 173 receives a pilot pressure at a right pilot port 173R to move leftward to rotate the turning hydraulic motor 2A forward, that is, rotate the upper turning body 3 rightward. Furthermore, when the left operating lever 26L is tilted leftward (in the +Y direction), the control valve 173 receives a pilot pressure at a left pilot port 173L to move rightward to reverse the turning hydraulic motor 2A, that is, rotate the upper turning body 3 leftward.

The control valve 174 is a spool valve for supplying hydraulic oil discharged by the main pump 14R to the bucket cylinder 9 and to discharge hydraulic oil in the bucket cylinder 9 to the hydraulic oil tank. When the right operating lever 26R is tilted leftward (in the +Y direction), the control valve 174 receives a pilot pressure at a left pilot port 174L to move rightward and extends the bucket cylinder 9 to close the bucket 6. Furthermore, when the right operating lever 26R is tilted rightward (in the −Y direction), the control valve 174 receives a pilot pressure at a right pilot port 174R to move leftward and retracts the bucket cylinder 9 to open the bucket 6.

The control valves 175 and 176 are spool valves that switch the flow of hydraulic oil in order to supply hydraulic oil discharged by the main pumps 14L and 14R to the boom cylinder 7 and to discharge hydraulic oil in the boom cylinder 7 to the hydraulic oil tank. When the right operating lever 26R is tilted backward (in the −X direction), the control valve 175 receives a pilot pressure at a right pilot port 175R to move leftward and extends the boom cylinder 7 to raise the boom 4. When the right operating lever 26R is tilted forward (in the +X direction), the control valve 176 receives a pilot pressure at a right pilot port 176R to move leftward and retracts the boom cylinder 7 to lower the boom 4. Furthermore, when the right operating lever 26R is tilted backward (in the −X direction), the control valve 176 receives a pilot pressure at a left pilot port 176L to move rightward and extends the boom cylinder 7 to raise the boom 4.

The control valves 177 and 178 are spool valves that switch the flow of hydraulic oil in order to supply hydraulic oil discharged by the main pumps 14L and 14R to the arm cylinder 8 and to discharge hydraulic oil in the arm cylinder 8 to the hydraulic oil tank. When the left operating lever 26L is tilted forward (in the +X direction), the control valve 177 receives a pilot pressure at a left pilot port 177L to move rightward and retracts the arm cylinder 8 to open the arm 5. Furthermore, when the left operating lever 26L is tilted backward (in the −X direction), the control valve 177 receives a pilot pressure at a right pilot port 177R to move leftward and extends the arm cylinder 8 to close the arm 5. When the left operating lever 26L is tilted forward (in the +X direction), the control valve 178 receives a pilot pressure at a right pilot port 178R to move leftward and retracts the arm cylinder 8 to open the arm 5. Furthermore, when the left operating lever 26L is tilted backward (in the −X direction), the control valve 178 receives a pilot pressure at a left pilot port 178L to move rightward and extends the arm cylinder 8 to close the arm 5.

The operating apparatus 26 supplies hydraulic oil discharged by the pilot pump 15 to the pilot ports of control valves corresponding to hydraulic actuators through a pilot line. A pilot pressure, which is the pressure of hydraulic oil supplied to each pilot port, is a pressure commensurate with the operation details of the operating apparatus 26 corresponding to each hydraulic actuator. The operation details include, for example, the direction of operation and the amount of operation.

The operating pressure sensor 29 detects the details of the operator's operation using the operating apparatus 26 in the form of pressure. The operation details of the operating apparatus 26, however, may also be detected in the form of a physical quantity other than pressure. According to this embodiment, for example, the operating pressure sensor 29 detects the operation details of the operating apparatus 26 corresponding to each hydraulic actuator in the form of pressure, and outputs the detected values to the controller 30. The operating pressure sensor 29 includes a left operating pressure sensor 29L, a right operating pressure sensor 29R, a left travel pressure sensor 29DL, and a right travel pressure sensor 29DR.

The left operating pressure sensor 29L detects the operation details of the left operating lever 26L. The right operating pressure sensor 29R detects the operation details of the right operating lever 26R. The left travel pressure sensor 29DL detects the operation details of the left travel lever 26DL and the left travel pedal 26PL. The right travel pressure sensor 29DR detects the operation details of the right travel lever 26DR and the right travel pedal 26PR.

The controller 30 is a control device for controlling the shovel. According to this embodiment, the controller 30 is composed of a computer that includes a CPU, a volatile storage device, and a nonvolatile storage device. The controller 30 executes programs corresponding to various functions to implement the various functions.

The gate lock valve 50 is a solenoid valve that switches opening and closing of a conduit L1 that connects the operating apparatus 26 and the pilot pump 15. According to this embodiment, the gate lock valve 50 opens the conduit L1 in response to receiving an unlocking signal and closes the conduit L1 when not receiving the unlocking signal. The gate lock valve 50 may close the conduit L1 in response to receiving a locking signal. The gate lock valve 50 may be composed of a proportional reducing valve.

For example, when the gate lock lever D1 is in the unlocking state and the gate lock valve 50 is closed, the controller 30 outputs an unlocking signal to the gate lock valve 50 in response to determining that the operating apparatus 26 is operated with the operator's hand. That is, when not outputting an unlocking signal to the gate lock valve 50 or outputting a locking signal to the gate lock valve 50, the controller 30 outputs an unlocking signal to the gate lock valve 50 in response to determining that the operating apparatus 26 is operated with the operator's hand. When the gate lock lever D1 is in the locking state, the controller 30 does not output an unlocking signal to the gate lock valve 50 even if the controller 30 determines that the operating apparatus 26 is operated with the operator's hand. This is for preventing the operating apparatus 26 that has been switched to the disabled state by the gate lock lever D1 from being switched to the restricted state (enabled state). In this case, the controller 30 may output a locking signal to the gate lock valve 50. The controller 30 may be configured not to output an unlocking signal in response to receiving no seating signal from the seat occupation switch or receiving no seat belt wearing signal from the seat belt switch.

The controller 30 determines whether the operating apparatus 26 is operated with the operator's hand based on, for example, the output of the image capturing device D3 serving as a detector. For example, the controller 30 determines whether at least one of the left operating lever 26L and the right operating lever 26R is operated while the left operating lever 26L is held with the operator's left hand and the right operating lever 26R is held with the operator's right hand. It may be determined as desired, based on a work site, work status, etc., whether the controller 30 performs this determination.

According to this embodiment, the controller 30 determines, using an image recognition technique, whether an image captured by the image capturing device D3 shows the operator operating the operating apparatus 26 with her/his hand. In response to determining that the operator operating the operating apparatus 26 with her/his hand is shown, the controller 30 determines that the operating apparatus 26 is operated with the operator's hand. In response to identifying the operator's hand within a predetermined area around the operating apparatus 26, the controller 30 may determine that the operating apparatus 26 is operated with the operator's hand even before the operator's hand touches the operating apparatus 26. The controller 30 may also determine that the operating apparatus 26 is operated with the operator's hand when the operator operating the operating apparatus 26 with her/his hand is shown while it is detected based on the output of the seat occupation switch that the operator is seated. That is, when it is not detected that the operator is seated, the controller 30 may not determine that the operating apparatus 26 is operated with the operator's hand even when the operator operating the operating apparatus 26 with her/his hand is shown. Furthermore, the controller 30 may not determine that the operating apparatus 26 is operated with the operator's hand when the operator touches the operating apparatus 26 with her/his hand open. Furthermore, the controller 30 may determine, based on the output of the image capturing device D3, whether the operator is performing operations while standing.

Even when identifying the operator's hand within a predetermined area around the operating apparatus 26, the controller 30 may not determine that the operating apparatus 26 is operated with the operator's hand if the posture of the hand is not suitable for operation. For example, when the operator brings her/his hand closer to the operating apparatus 26 with the hand closed or the palm facing upward, the controller 30 may not determine that the operating apparatus 26 is operated with the operator's hand. Furthermore, when the operator brings her/his hand closer to the operating apparatus 26 while holding another object in the hand, the controller 30 may not determine that the operating apparatus 26 is operated with the operator's hand.

The way of holding an operating lever and the positional relationship between the hand and an operating lever as shown in the monitoring areas A1 and A2 of FIG. 3 may be prestored in a nonvolatile storage device or the like as reference images. The controller 30 may determine, based on the prestored reference images, whether the operating apparatus 26 is operated with the operator's hand. Specifically, the controller 30 compares an image showing the way of holding an operating lever included in an image captured by the image capturing device D3 with an image showing the way of holding an operating lever included in each of one or more prestored reference images, in order to determine whether there is a reference image that includes an image of the same way of holding as the image showing the way of holding an operating lever included in the image captured by the image capturing device D3. The controller 30 may determine that the operating apparatus 26 is operated with the operator's hand if there is such a reference image, and may determine that the operating apparatus 26 is not operated with the operator's hand if there is not such a reference image.

For example, in the case of identifying the operator's hand from an image captured by the image capturing device D3, using an image recognition technique, the controller 30 may identify a portion from the wrist to a fingertip as the hand and identify a portion on the trunk side of the wrist as a portion other than the hand.

The controller 30 controls the status of the operating apparatus 26 according to the determination result. For example, when the shovel is in a standby state and the gate lock lever D1 is in the unlocking state, the controller 30 switches the operating apparatus 26 to the enabled state in response to determining that the operating apparatus 26 is operated with the operator's hand. The standby state means a state where at least the controller 30 is activated, the engine 11 is in operation, and the operating apparatus 26 is not operated.

Figure 5:
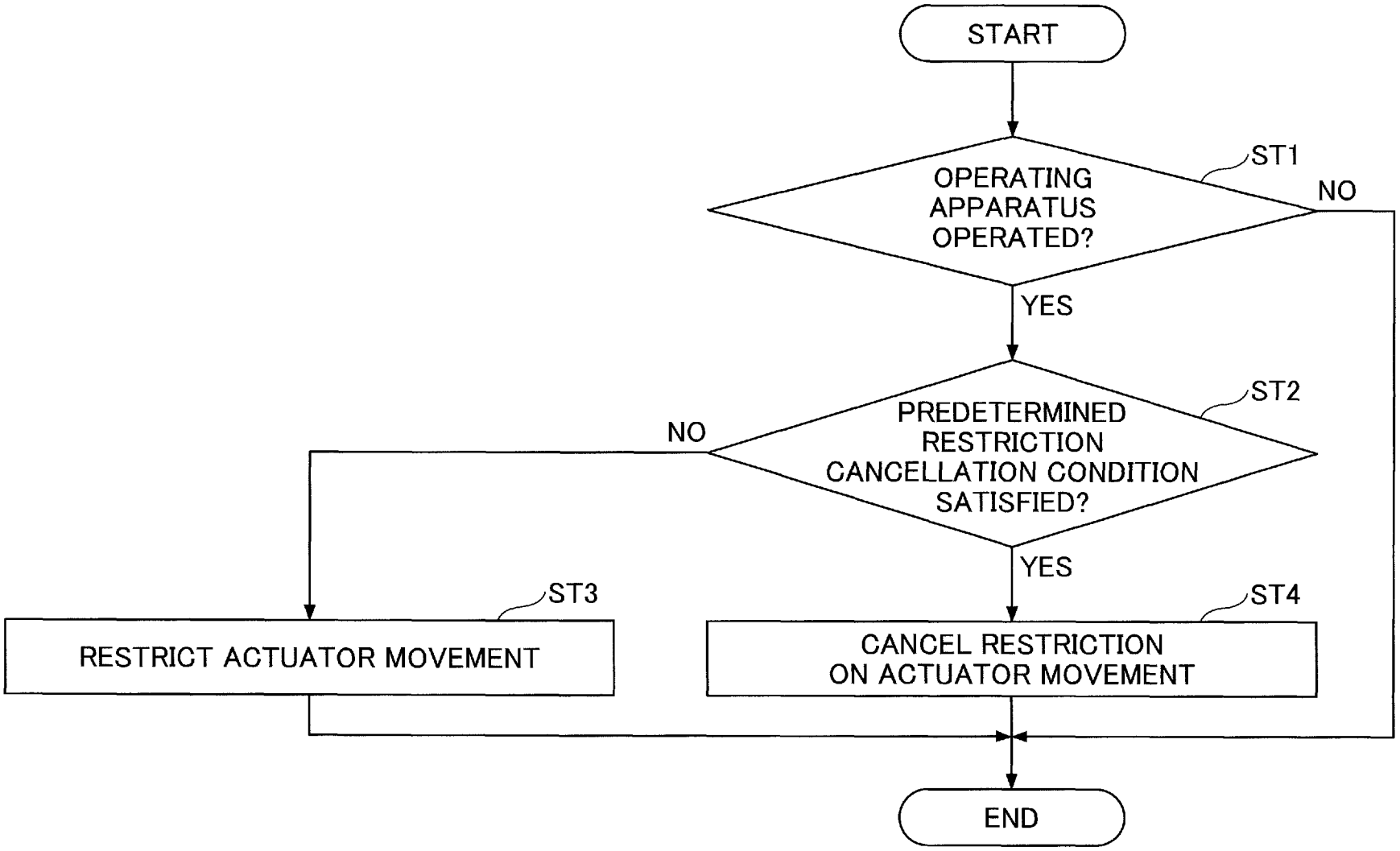
FIG. 5 is a flowchart of a restriction canceling process.

Next, an example of a process of canceling the restricted state of the operating apparatus 26 by the controller 30 (hereinafter, "restriction canceling process") is described with reference to FIG. 5. FIG. 5 is a flowchart of an example of the restriction canceling process. For example, when the shovel is in the standby state, the controller 30 repeatedly executes this restriction canceling process at predetermined control intervals.

First, the controller 30 determines whether the operating apparatus 26 is operated (step ST1). According to this embodiment, the controller 30 determines whether the operating apparatus 26 is operated based on the output of the operating pressure sensor 29. For example, the controller 30 determines whether the left operating lever 26L is operated based on the output of the left operating pressure sensor 29L.

In response to determining that the operating apparatus 26 is not operated (NO at step ST1), the controller 30 ends the restriction canceling process of this time without canceling the restricted state of the operating apparatus 26.

In response to determining that the operating apparatus 26 is operated (YES at step ST1), the controller 30 determines whether a predetermined restriction cancellation condition is satisfied (step ST2). According to this embodiment, the controller 30 determines, based on an image captured by the image capturing device D3, whether the operating apparatus 26 is operated with the operator's hand. For example, in response to determining that the left operating lever 26L is operated, the controller 30 determines, based on an image captured by the image capturing device D3, whether the left operating lever 26L is operated with the operator's left hand.

In response to determining that a predetermined restriction cancellation condition is not satisfied (NO at step ST2), the controller 30 restricts the movement of an actuator (step ST3). According to this embodiment, in response to determining that the operating apparatus 26 is not operated with the operator's hand, the controller 30 keeps the operating apparatus 26 in the restricted state. The controller 30 ends the restriction canceling process of this time without outputting an unlocking signal to the gate lock valve 50, namely, without canceling the restricted state of the operating apparatus 26. Therefore, the conduit L1 remains closed. In this case, a hydraulic actuator does not move even when, for example, the operator's elbow contacts the operating apparatus 26 to accidentally operate the operating apparatus 26 or the operator catches her/his jacket sleeve on the operating apparatus 26 to accidentally operate the operating apparatus 26. The controller 30 may determine that the operating apparatus 26 is not operated with the operator's hand in response to determining, based on an image captured by the image capturing device D3, that the left operating lever 26L is operated with the operator's right hand. The same applies in the case of determining that the right operating lever 26R is operated with the operator's left hand.

The controller 30 may restrict the movement of an actuator using a device other than the gate lock valve 50. For example, in response to determining that the operating apparatus 26 is not operated with the operator's hand, the controller 30 may restrict the movement of an actuator by reducing a pilot pressure that acts on a control valve by reducing the output of the pilot pump 15 serving as a pilot pressure generator. Alternatively, in response to determining that the operating apparatus 26 is not operated with the operator's hand, the controller 30 may restrict the movement of a hydraulic actuator by reducing the flow rate of hydraulic oil supplied to the actuator by reducing the output of the main pump 14. In these cases, the function of keeping or canceling the restricted state of the operating apparatus 26 using the gate lock valve 50 may be omitted.

In response to determining that a predetermined restriction canceling condition is satisfied (YES at step ST2), the controller 30 cancels a restriction on the movement of an actuator (step ST4). According to this embodiment, in response to determining that the operating apparatus 26 is operated with the operator's hand, the controller 30 switches the operating apparatus 26 to the enabled state. Specifically, the controller 30 outputs an unlocking signal to the gate lock valve 50 to open the conduit L1. In this case, a hydraulic actuator moves according to the operator's operation on the operating apparatus 26.

According to the above-described process, the controller 30 can prevent a hydraulic actuator from moving when the operating apparatus 26 is accidentally operated.

Figure 6:
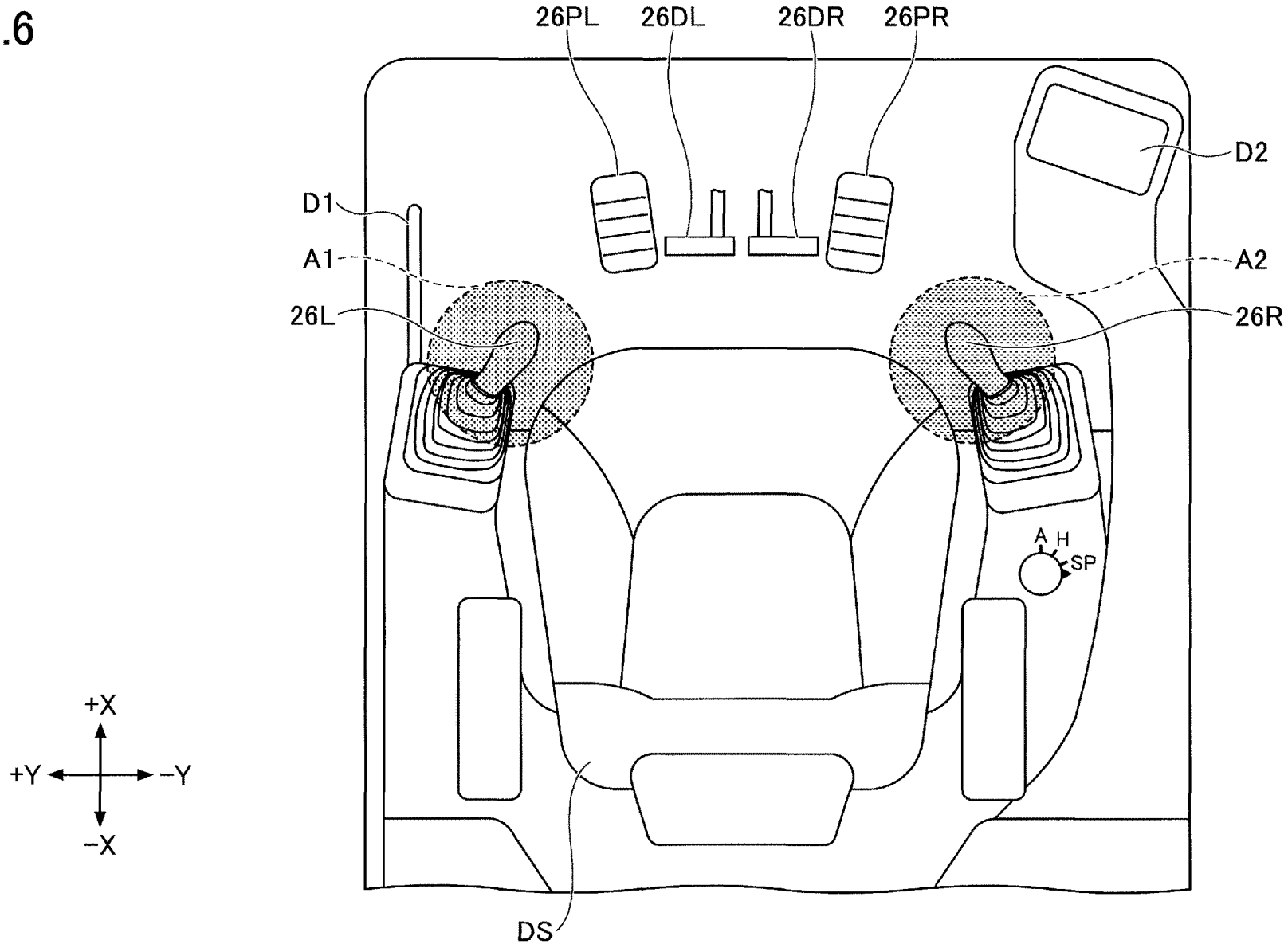
FIG. 6 is a plan view of the inside of the cab of FIG. 2.
Figure 7:
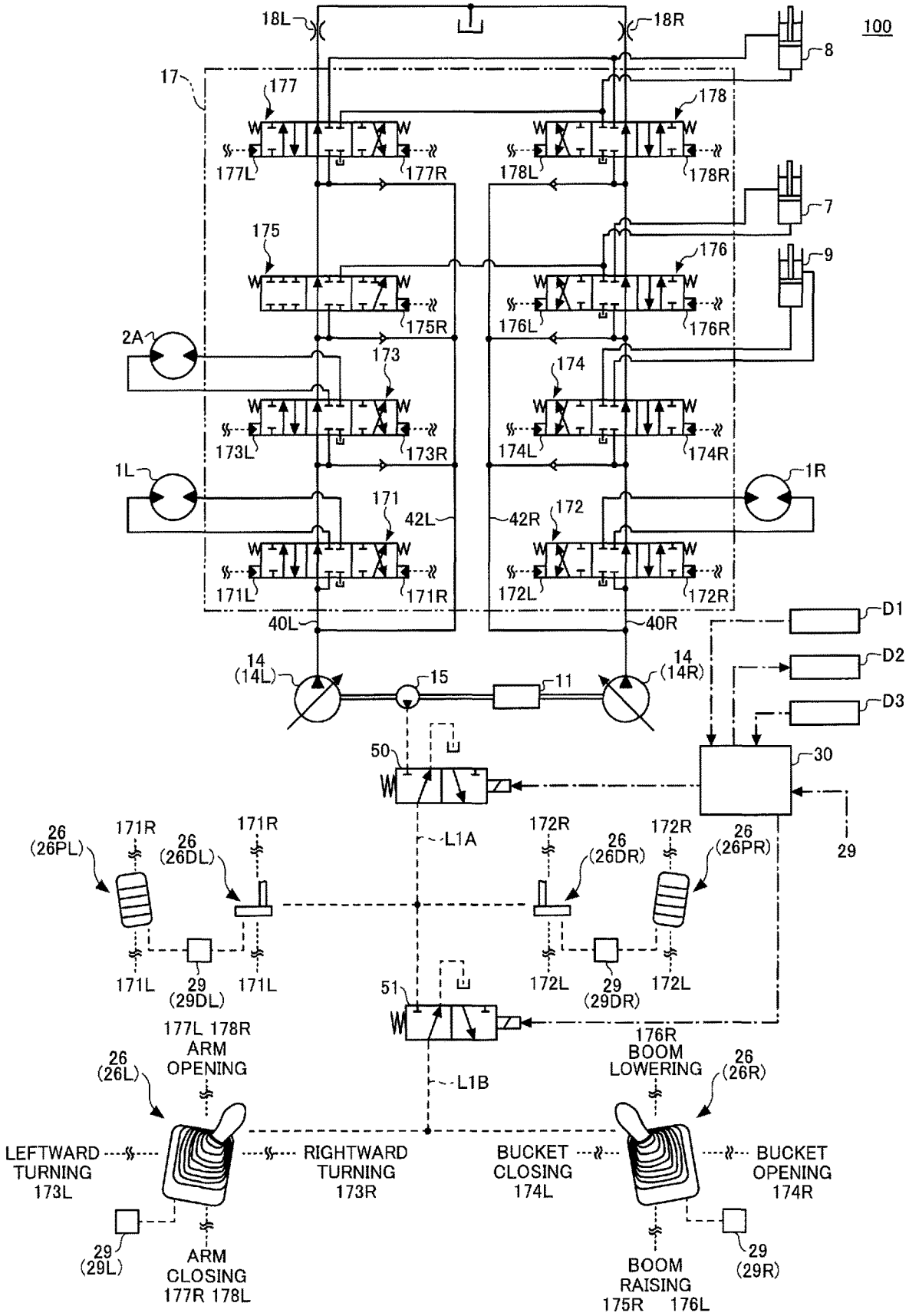
FIG. 7 is a diagram illustrating another example configuration of the control system installed in the shovel of FIG. 1.

Next, another example configuration of the control system 100 is described with reference to FIGS. 6 and 7. FIG. 6 is a plan view of the inside of the cab 10 and corresponds to FIG. 3. FIG. 7 is a schematic diagram illustrating another example configuration of the control system 100 and corresponds to FIG. 4. The control system of FIG. 7 is different from the control system 100 of FIG. 4 in not monitoring the monitoring area A3 illustrated in FIG. 3. That is, the control system of FIG. 7 is different from the control system 100 of FIG. 4 in not detecting whether the left travel lever 26DL and the right travel lever 26DR are operated with the operator's hand and in including a selector valve 51. Otherwise, the control system of FIG. 7 is equal to the control system 100 of FIG. 4. Therefore, a description of a common portion is omitted, and differences are described in detail.

According to the control system 100 of FIG. 7, the gate lock valve 50 is a solenoid valve that switches opening and closing of a conduit L1A that connects the left travel lever 26DL, the right travel lever 26DR, the left travel pedal 26PL, and the right travel pedal 26PR to the pilot pump 15. According to this embodiment, the gate lock valve 50 opens the conduit L1A in response to receiving an unlocking signal and closes the conduit L1A in response to receiving no unlocking signal. The gate lock valve 50 may close the conduit L1A in response to receiving a locking signal.

The selector valve 51 is a solenoid valve that switches opening and closing of a conduit Lib that connects each of the left operating lever 26L and the right operating lever 26R to the conduit L1A. According to this embodiment, the selector valve 51 opens the conduit L1B in response to receiving an unlocking signal and closes the conduit L1B in response to receiving no unlocking signal. The selector valve 51 may close the conduit L1B in response to receiving a locking signal. The selector valve 51 may be composed of a proportional reducing valve.

According to this configuration, the controller 30 can separately control the status of the operating apparatus 26 with respect to the lower traveling body 1 and the status of the operating apparatus 26 with respect to the upper turning body 3. For example, the controller 30 can put the operating apparatus 26 in the restricted state with respect to the upper turning body 3 while keeping the operating apparatus 26 in the enabled state with respect to the lower traveling body 1.

For example, the controller 30 can enable the travel levers and the travel pedals and restrict the left operating lever 26L and the right operating lever 26R by outputting an unlocking signal to the gate lock valve 50 and not outputting an unlocking signal to the selector valve 51.

According to this configuration, the controller 30 can prevent the upper turning body 3 from turning leftward and prevent the lower traveling body 1 from abruptly stopping moving when the operator touches the left operating lever 26L with her/his left elbow while operating the left travel lever 26DL and the right travel lever 26DR with her/his right hand.

Accordingly, the controller 30 can prevent the operator from accidentally moving actuators associated with the upper turning body 3 and from abruptly stopping the movement of the lower traveling body 1. The actuators associated with the upper turning body 3 include the turning hydraulic motor 2A, the boom cylinder 7, the arm cylinder 8, and the bucket cylinder 9.

Next, another example configuration of an operation system that moves a control valve according as the operating apparatus 26 is operated is described with reference to FIGS. 8 and 9.

Figure 8:
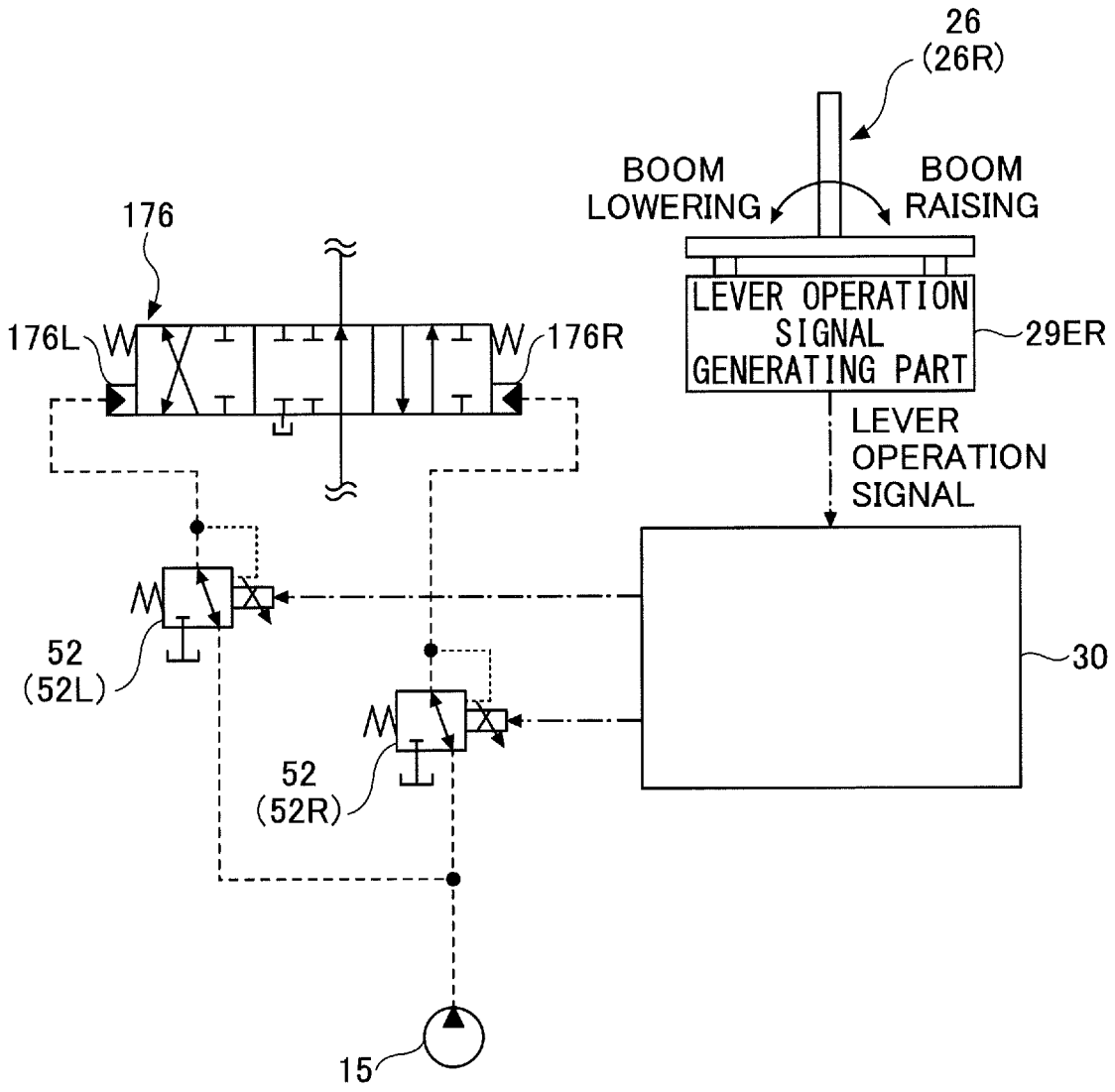
FIG. 8 is a diagram illustrating an example configuration of an operation system.

FIG. 8 illustrates an example of an operation system that moves the control valve 176 associated with the boom cylinder 7 according as the right operating lever 26R is operated. The operation system of FIG. 8 is different in electrically detecting the details of the operator's operation using the right operating lever 26R from the operation system in each of FIGS. 4 and 7, which detects the details of the operator's operation in the form of pressure. The description of the operation system of FIG. 8 is likewise applied to other operation systems such as an operation system that moves the control valve 177 associated with the arm cylinder 8 according as the left operating lever 26L is operated and an operation system that moves the control valve 174 associated with the bucket cylinder 9 according as the right operating lever 26R is operated.

According to the illustration of FIG. 8, when the right operating lever 26R is operated in the boom raising direction, a lever operation signal generating part 29ER generates a lever operation signal that is an electrical signal commensurate with the amount of operation, and outputs the lever operation signal to the controller 30. The controller 30 generates a current command commensurate with the lever operation signal, and outputs the current command to a solenoid proportional valve 52L. The solenoid proportional valve 52L uses the pressure of hydraulic oil discharged by the pilot pump 15 (primary pressure) to generate a secondary pressure commensurate with the current command (pilot pressure), and causes the secondary pressure to act on the left pilot port 176L of the control valve 176. The control valve 176 receives the pilot pressure at the left pilot port 176L to move rightward to cause hydraulic oil discharged by the main pump 14R to flow into the bottom-side oil chamber of the boom cylinder 7. The boom cylinder 7 extends to raise the boom 4 when the hydraulic oil flows into the bottom-side oil chamber.

When the right operating lever 26R is operated in the boom lowering direction, the lever operation signal generating part 29ER generates a lever operation signal commensurate with the amount of operation, and outputs the lever operation signal to the controller 30. The controller 30 generates a current command commensurate with the lever operation signal, and outputs the current command to a solenoid proportional valve 52R. The solenoid proportional valve 52R uses the pressure of hydraulic oil discharged by the pilot pump 15 (primary pressure) to generate a secondary pressure commensurate with the current command (pilot pressure), and causes the secondary pressure to act on the right pilot port 176R of the control valve 176. The control valve 176 receives the pilot pressure at the right pilot port 176R to move leftward to cause hydraulic oil discharged by the main pump 14R to flow into the rod-side oil chamber of the boom cylinder 7. The boom cylinder 7 retracts to lower the boom 4 when the hydraulic oil flows into the rod-side oil chamber.

According to the illustration of FIG. 8, the controller 30 outputs a current command commensurate with the lever operation signal to a solenoid proportional valve 52 in response to determining that the right operating lever 26R is operated with the operator's hand, but outputs no current command to the solenoid proportional valve 52 in response to determining that the right operating lever 26R is not operated with the operator's hand. This is for preventing the boom cylinder 7 from moving when the right operating lever 26R is accidentally operated. Furthermore, the operation system of FIG. 8 can restrict the movement of the control valve 176 with the solenoid proportional valve 52. In this case, the operation system of FIG. 8 with the solenoid proportional valve 52 may include the gate lock valve 50 (see FIG. 4), the selector valve 51 (see FIG. 7), etc. Alternatively, the gate lock valve 50, the selector valve 51, etc., may be omitted in the operation system of FIG. 8.

Figure 9:
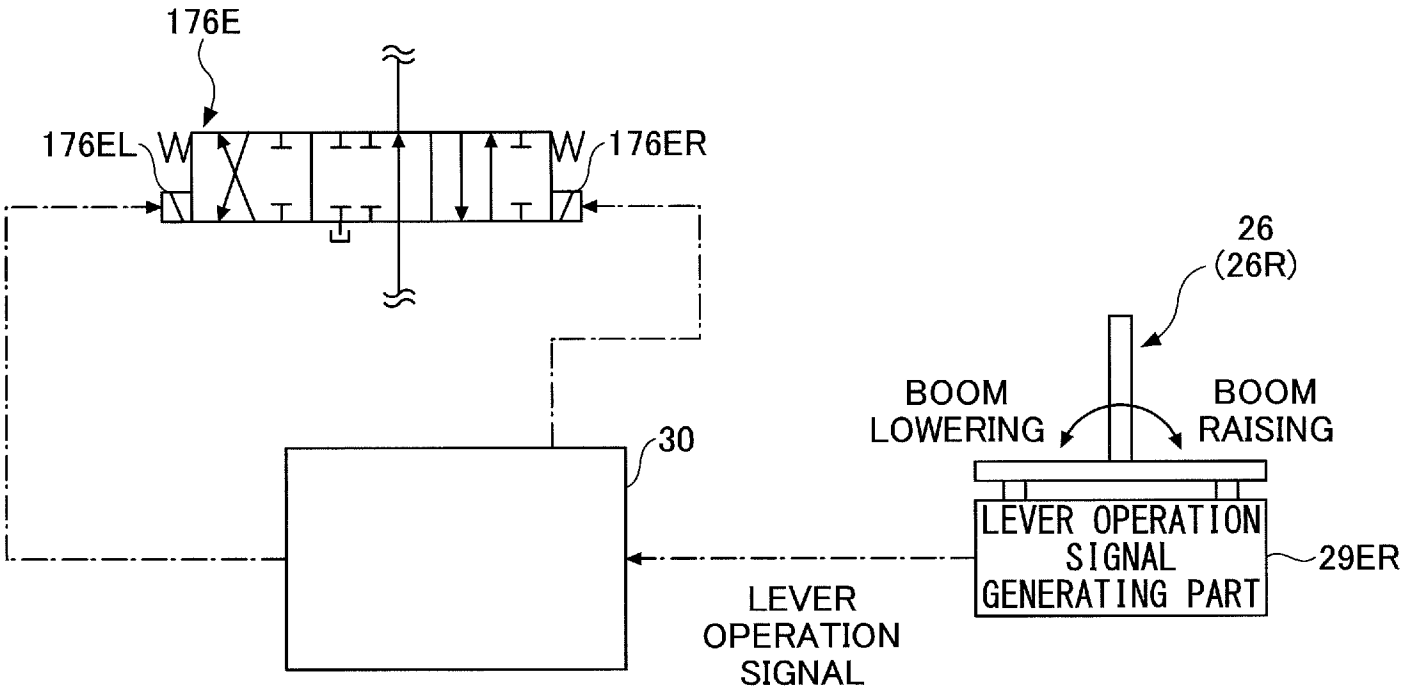
FIG. 9 is a diagram illustrating another example configuration of the operation system.

FIG. 9 illustrates an example of an operation system that moves a solenoid spool valve 176E associated with the boom cylinder 7 according as the right operating lever 26R is operated. The operation system of FIG. 9 is different in electrically detecting the details of the operator's operation using the right operating lever 26R from the operation system in each of FIGS. 4 and 7, which detects the details of the operator's operation in the form of pressure. Furthermore, the operation system of FIG. 9 is different in using the solenoid spool valve 176E from the operation system in each of FIGS. 4 and 7, which uses the control valve 176 that is a hydraulic spool valve. The description of the operation system of FIG. 9 is likewise applied to other operation systems such as an operation system that moves the control valve 177 associated with the arm cylinder 8 according as the left operating lever 26L is operated and an operation system that moves the control valve 174 associated with the bucket cylinder 9 according as the right operating lever 26R is operated.

According to the illustration of FIG. 9, when the right operating lever 26R is operated in the boom raising direction, the lever operation signal generating part 29ER generates a lever operation signal that is an electrical signal commensurate with the amount of operation, and outputs the lever operation signal to the controller 30. The controller 30 generates a current command commensurate with the lever operation signal, and outputs the current command to a left solenoid 176EL of the solenoid spool valve 176E. The solenoid spool valve 176E receives the current command at the left solenoid 176EL to move rightward to cause hydraulic oil discharged by the main pump 14R to flow into the bottom-side oil chamber of the boom cylinder 7. The boom cylinder 7 extends to raise the boom 4 when the hydraulic oil flows into the bottom-side oil chamber.

When the right operating lever 26R is operated in the boom lowering direction, the lever operation signal generating part 29ER generates a lever operation signal commensurate with the amount of operation, and outputs the lever operation signal to the controller 30. The controller 30 generates a current command commensurate with the lever operation signal, and outputs the current command to a right solenoid 176ER of the solenoid spool valve 176E. The solenoid spool valve 176E receives the current command at the right solenoid 176ER to move leftward to cause hydraulic oil discharged by the main pump 14R to flow into the rod-side oil chamber of the boom cylinder 7. The boom cylinder 7 retracts to lower the boom 4 when the hydraulic oil flows into the rod-side oil chamber.

Thus, according to the illustration of FIG. 9, the controller 30 can move the solenoid spool valve 176E without using the pressure of hydraulic oil discharged by the pilot pump 15.

According to the illustration of FIG. 9, the controller 30 outputs a current command commensurate with the lever operation signal to the solenoid spool valve 176E in response to determining that the right operating lever 26R is operated with the operator's hand, but outputs no current command to the solenoid spool valve 176E in response to determining that the right operating lever 26R is not operated with the operator's hand. This is for preventing the boom cylinder 7 from moving when the right operating lever 26R is accidentally operated. Furthermore, according to the operation system of FIG. 9, the controller 30 can directly restrict the movement of the solenoid spool valve 176E. In this case, the operation system of FIG. 9 with the solenoid spool valve 176E may include mechanisms corresponding to the gate lock valve 50 (see FIG. 4), the selector valve 51 (see FIG. 7), etc. Alternatively, the gate lock valve 50, the selector valve 51, etc., or mechanisms corresponding thereto may be omitted in the operation system of FIG. 9.

As described above, a shovel according to an embodiment of the present invention includes the lower traveling body 1, the upper turning body 3 turnably mounted on the lower traveling body 1, the cab 10 mounted on the upper turning body 3, the operating apparatus 26 installed in the cab 10, an actuator driven with the operating apparatus 26, and the controller 30 serving as a control device that can restrict the movement of the actuator. The controller 30 determines the necessity of a restriction related to the movement of the actuator in accordance with whether the operating apparatus 26 is operated with the operator's hand. For example, the controller 30 removes a restriction related to the movement of the actuator in response to determining that the operating apparatus 26 is operated with the operator's hand, and restricts the movement of the actuator in response to not determining that the operating apparatus 26 is operated with the operator's hand. That is, the controller 30 restricts the movement of the actuator until determining that the operating apparatus 26 is operated with the operator's hand. The controller 30, however, may restrict the movement of the actuator in response to determining that the operating apparatus 26 is not operated with the operator's hand. That is, the controller 30 may be prevented from restricting the movement of the actuator until determining that the operating apparatus 26 is not operated with the operator's hand.

For example, the controller 30 may determine whether the operating apparatus 26 is operated with the operator's hand based on the output of a detector to detect that the operating apparatus 26 is operated with the operator's hand.

The detector is, for example, the image capturing device D3. The detector, however, may also be a contact detector such as an electrostatic sensor or a pressure-sensitive sensor attached to a surface of the operating apparatus 26, a non-contact detector other than the image capturing device D3, such as a pyroelectric sensor, a thermopile sensor, a thermography camera, or a space recognition device attached inside the cab 10, or the like. Examples of space recognition devices include a three-dimensional distance measuring device, a LIDAR, a millimeter wave radar, etc.

The image capturing device D3 is, for example, one or more cameras attached inside the cab 10. Examples of cameras include a monocular camera, a stereo camera, a distance image camera, an infrared camera, etc.

The controller 30 may restrict the movement of an actuator by reducing a pilot pressure that is generated according as the operating apparatus 26 is operated. For example, the controller 30 reduces a pilot pressure that is generated according as the operating apparatus 26 is operated by reducing the pressure of hydraulic oil in the conduit L1 by controlling the gate lock valve 50. As a result, it is possible to cause the stroke amount of the control valves 171 through 178 that move according to a pilot pressure to decrease or disappear, and to slow or stop the movement of each of the left traveling hydraulic motor 1L, the right traveling hydraulic motor 1R, the turning hydraulic motor 2A, the boom cylinder 7, the arm cylinder 8, and the bucket cylinder 9.

The controller 30 may reduce a pilot pressure that is generated according as each of the left operating lever 26L and the right operating lever 26R is operated by reducing the pressure of hydraulic oil in the conduit L1B by controlling the selector valve 51 (see FIG. 7). As a result, it is possible to cause the stroke amount of the control valves 173 through 178 that move according to a pilot pressure to decrease or disappear, and to slow or stop the movement of each of the turning hydraulic motor 2A, the boom cylinder 7, the arm cylinder 8, and the bucket cylinder 9. In this case, the movement of each of the left traveling hydraulic motor 1L and the right traveling hydraulic motor 1R is not restricted.

A preferred embodiment of the present invention is described above. The present invention, however, is not limited to the above-described embodiment. Various variations, replacements, etc., may be applied to the above-described embodiment without departing from the scope of the present invention. Furthermore, the features described with reference to the above-described embodiment may be suitably combined as long as causing no technical contradiction.

For example, the controller 30 may be configured to restrict the movement of an actuator in response to determining that an operating lever is not operated with the operator's hand, that is, is operated through contact with part of the operator other than the hands or with an object. The controller 30 may be configured to remove a restriction on the movement of the actuator in response to determining that the operating lever is operated with the operator's hand. The same is the case with a travel lever. The controller 30, however, may be configured to determine the necessity of restricting a travel pedal from moving an actuator in accordance with whether the travel pedal is operated with the operator's foot. Specifically, the controller 30 may be configured to restrict the movement of a traveling hydraulic motor in response to determining that the travel pedal is not operated with the operator's foot, that is, is operated through contact with part of the operator other than the feet or with an object. The controller 30 may be configured to remove a restriction on the movement of the traveling hydraulic motor in response to determining that the travel pedal is operated with the operator's foot.

In response to determining that an operating lever is not operated with the operator's hand, that is, is operated through contact with part of the operator other than the hands or with an object, the controller 30 may notify the worker to that effect with at least one notification measure among a screen display, an alarm sound, vibrations, etc.

Furthermore, according to the above-described embodiment, the selector valve 51 is composed of a single selector valve that can simultaneously switch the respective statuses of the left operating lever 26L and the right operating lever 26R. The selector valve 51, however, may alternatively be composed of two or more selector valves such as a selector valve associated with the left operating lever 26L and a selector valve associated with the right operating lever 26R in combination. In this case, the selector valve 51 can switch the status of the left operating lever 26L and the status of the right operating lever 26R separately.

Furthermore, according to the above-described embodiment, the selector valve 51 is composed of a single selector valve placed in the conduit L1B connecting the pilot pump 15 and operating levers (the left operating lever 26L and the right operating lever 26R). The selector valve 51, however, may alternatively be composed of multiple selector valves placed in conduits connecting operating levers and the pilot ports of control valves. In this case, the selector valve 51 can control enabling or disabling operations on each hydraulic actuator individually.

What is claimed is:

1. A shovel comprising:

a lower traveling body;

an upper turning body turnably mounted on the lower traveling body;

a cab mounted on the upper turning body;

an operating apparatus installed in the cab;

an actuator driven with the operating apparatus, and a processor configured to restrict a movement of the actuator, wherein the processor is configured to make a determination as to whether the operating apparatus is operated with a hand of an operator based on an output of a detector and determine a necessity of a restriction related to the movement of the actuator in accordance with said determination.

2. The shovel as claimed in claim 1, wherein the processor is configured to make said determination based on an output of one or more cameras attached inside the cab.

3. The shovel as claimed in claim 1, wherein the processor is configured to restrict the movement of the actuator by reducing a pilot pressure that is generated according as the operating apparatus is operated.

4. The shovel as claimed in claim 3, wherein the processor is configured to reduce the pilot pressure with a gate lock valve.

5. The shovel as claimed in claim 3, wherein the processor is configured to reduce the pilot pressure with a valve other than a gate lock valve.

6. The shovel as claimed in claim 1, wherein the processor is configured to determine a necessity of restricting a travel pedal from causing the movement of the actuator in accordance with whether the travel pedal is operated with a foot of the operator.

7. The shovel as claimed in claim 1, further comprising:

a selector valve installed between a pilot pressure generator and a control valve, wherein a pilot pressure that is generated according as the operating apparatus is operated is controlled with the selector valve.

8. The shovel as claimed in claim 1, further comprising:

a proportional reducing valve installed between a pilot pressure generator and a control valve, wherein the processor is configured to restrict the movement of the actuator by controlling the proportional reducing valve.

9. The shovel as claimed in claim 1, wherein the processor is configured to restrict the movement of the actuator until determining that the operating apparatus is operated with the hand of the operator.

10. The shovel as claimed in claim 1, wherein the processor is configured not to restrict the movement of the actuator until determining that the operating apparatus is not operated with the hand of the operator.

11. The shovel as claimed in claim 1, wherein the processor is configured not to remove the restriction in response to determining that the operating apparatus is operated with the hand of the operator, when a gate lock lever is in a locking state.

12. The shovel as claimed in claim 1, wherein the detector is electrically connected to the processor and configured to detect that the operating apparatus is operated with the hand of the operator, and the processor is configured to make said determination by processing an electrical signal output from the detector.

13. A shovel comprising:

a lower traveling body;

an upper turning body turnably mounted on the lower traveling body;

a cab mounted on the upper turning body;

an operating apparatus installed in the cab;

an actuator driven with the operating apparatus, and a processor configured to restrict a movement of the actuator, wherein the processor is configured to make a determination as to whether the operating apparatus is operated with a hand of an operator based on an output of a detector, determine whether a restriction related to the movement of the actuator is necessary or not in accordance with said determination, and restrict the movement of the actuator in response to determining that the restriction is necessary.

* * * * *